US010322584B2

(12) United States Patent
Yamamuro et al.

(10) Patent No.: US 10,322,584 B2
(45) Date of Patent: Jun. 18, 2019

(54) METHOD FOR MANUFACTURING LIQUID EJECTION HEAD

(71) Applicant: CANON KABUSHIKI KAISHA, Tokyo (JP)

(72) Inventors: Jun Yamamuro, Yokohama (JP); Kenji Fujii, Yokohama (JP); Kazuhiro Asai, Kawasaki (JP); Keiji Matsumoto, Fukushima (JP); Koji Sasaki, Nagareyama (JP); Kunihito Uohashi, Yokohama (JP); Seiichiro Yaginuma, Kawasaki (JP); Masahisa Watanabe, Yokohama (JP); Ryotaro Murakami, Yokohama (JP); Tomohiko Nakano, Kawasaki (JP); Keiji Edamatsu, Kawasaki (JP); Haruka Nakada, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/489,501

(22) Filed: Apr. 17, 2017

(65) Prior Publication Data

US 2017/0297336 A1 Oct. 19, 2017

(30) Foreign Application Priority Data

Apr. 18, 2016 (JP) ..... 2016-083248
Feb. 20, 2017 (JP) ..... 2017-029506

(51) Int. Cl.
*B41J 2/16* (2006.01)
*B41J 2/14* (2006.01)

(52) U.S. Cl.
CPC ..... *B41J 2/1607* (2013.01); *B41J 2/1603* (2013.01); *B41J 2/1623* (2013.01); *B41J 2/1628* (2013.01); *B41J 2/1631* (2013.01); *B41J 2/1634* (2013.01); *B41J 2/1639* (2013.01); *B41J 2002/14459* (2013.01)

(58) Field of Classification Search
CPC ..... B41J 2/1404; B41J 2/1607; B41J 2/1623; B41J 2/1628; B41J 2/1631; B41J 2/1642; B41J 2/1643; B41J 2/1646
See application file for complete search history.

(56) References Cited

U.S. PATENT DOCUMENTS 5,387,314 A * 2/1995 Baughman ..... B41J 2/1404 216/16
6,315,397 B2 * 11/2001 Truninger ..... B41J 2/1603 347/63
6,666,546 B1 * 12/2003 Buswell ..... B41J 2/14145 347/65
7,168,787 B2 * 1/2007 Jung ..... B41J 2/1603 347/47

(Continued)

*Primary Examiner* — Anh T Vo
(74) *Attorney, Agent, or Firm* — Canon U.S.A., Inc. IP Division

(57) ABSTRACT

A method for manufacturing a liquid ejection head including the steps of preparing a substrate including, on a surface of the substrate, a layer having a plurality of openings in which opening portions of supply portions are located and which are arrayed in an array direction and another opening which is different from the plurality of openings and is located beyond the array end portion in the array direction, and attaching a dry film for forming flow passages to the substrate and the layer.

20 Claims, 5 Drawing Sheets

(56) References Cited

U.S. PATENT DOCUMENTS

| | | | | |
|---|---|---|---|---|
| 7,479,203 | B2 * | 1/2009 | Bernard | B32B 37/0023 156/308.2 |
| 8,083,324 | B2 | 12/2011 | Kwon | |
| 8,109,608 | B2 * | 2/2012 | Fannin | B41J 2/1404 264/154 |
| 8,162,440 | B2 * | 4/2012 | Park | B41J 2/14129 29/890.1 |
| 9,623,657 | B2 * | 4/2017 | Choy | B05B 1/14 |

* cited by examiner

METHOD FOR MANUFACTURING LIQUID EJECTION HEAD

BACKGROUND OF THE INVENTION

Field of the Invention

The present disclosure relates to a method for manufacturing a liquid ejection head.

Description of the Related Art

A liquid ejection apparatus typified by an ink jet printer ejects a liquid from a liquid ejection head so as to record images and characters on a recording medium. There is a liquid ejection head in which a member provided with flow passages and ejection ports is disposed on a substrate provided with supply ports. Regarding a method for manufacturing such a liquid ejection head, U.S. Pat. No. 8,083,324 describes a method including a step of attaching a dry film to a substrate provided with supply ports so as to cover the supply ports. The dry film attached to the substrate is provided with flow passages produced by photolithography or the like. In instances where a dry film was attached to a substrate in the manner described in U.S. Pat. No. 8,083,324, it resulted in the shape of the attached dry film differing according to location and flow passages were formed in the dry film. Therefore, if the shape of the flow passage and the height from the substrate to an ejection port changed depending on the location, ejection of a liquid was affected making it difficult to form predetermined images on a recording medium.

Therefore, the present disclosure suppresses changes in the shape of the attached dry film depending on the location even when a liquid ejection head is produced by attaching, to the substrate, the dry film in which flow passages are to be formed.

SUMMARY OF THE INVENTION

The present disclosure provides a method for manufacturing a liquid ejection head including a substrate having liquid supply portions that open on a surface of the substrate, a layer disposed on the surface of the substrate, and a member which is disposed on the layer and forms flow passages in communication with ejection ports that are supplied with a liquid from the supply portions and eject the liquid, the method including the steps of preparing a substrate including, on the surface, a layer having a plurality of opening portions in which openings of the supply portions are located and which are arrayed in the array direction, and another opening which is different from the plurality of openings and is located beyond an outermost opening among the plurality of openings in the array direction, and attaching a dry film for forming the flow passages to the substrate and the layer.

Further features of the present disclosure will become apparent from the following description of exemplary embodiments with reference to the attached drawings.

DESCRIPTION OF THE EMBODIMENTS

Figure 1:
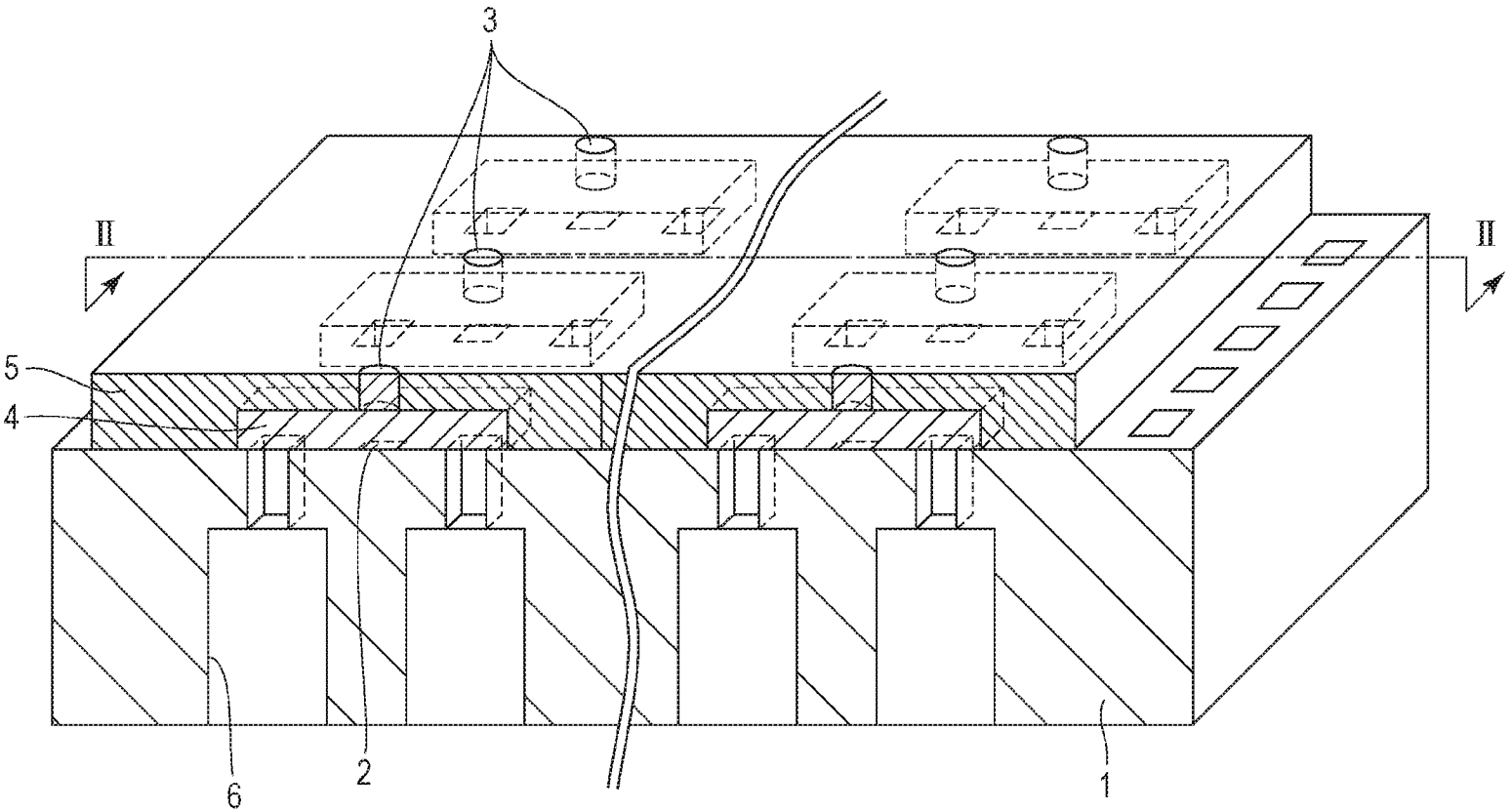
FIG. 1 is a diagram showing the configuration of a liquid ejection head.

FIG. 1 shows an example of the configuration of a liquid ejection head produced by the method for manufacturing a liquid ejection head according to the present disclosure.

A substrate 1 is composed of silicon or the like and includes energy generating elements 2 on a surface of the substrate. The energy generating element is formed from a heat generating resistor composed of TaSiN or a piezoelectric element. The energy generating elements 2 are arrayed in an array direction at a predetermined pitch. A liquid flow passage 4 is disposed between an ejection port 3 and the energy generating element 2. The ejection port 3 is disposed above the energy generating element 2. A member 5 for forming the ejection ports 3 and the flow passages 4 is composed of a single layer in FIG. 1 but may be multilayered. For example, a member for forming the flow passages 4 may be different from a member for forming the ejection ports 3. In the case where the members are different from each other, both are collectively denoted as a member 5. Although not shown in the drawing, a layer for enhancing the adhesiveness between the substrate 1 and the member 5 is disposed between (in the middle of) the substrate 1 and the member 5. The member 5 is disposed on the layer.

Liquid supply portions 6 for supplying a liquid to the flow passages 4 are disposed in the substrate 1. The supply portion 6 penetrates the substrate 1 and is open on the surface of the substrate 1. In FIG. 1, the supply portion 6 has a stepped shape in which the width is small on the surface side of the substrate and the width is large on the back surface side opposite to the surface of the substrate. The liquid is supplied from the supply portion 6 to the flow passage 4. The flow passage 4 is in communication with the ejection port 3. In the flow passage 4, a region including the energy generating element 2 may be denoted as a pressure chamber. The energy generating element 2 provides energy to the liquid supplied to the pressure chamber. The energy causes the liquid to be ejected from the ejection port 3 and the liquid is applied to a recording medium. In this manner, images and the like are recorded on the recording medium. Two supply portions 6 are connected to the pressure chamber. The liquid may be supplied from the two supply portions 6 to the pressure chamber, or the liquid may be supplied from one supply portion 6 to the pressure chamber, and the liquid in the pressure chamber may exit through the other supply portion 6. Alternatively, the liquid may be circulated between the inside of the pressure chamber and the outside of the pressure chamber through the two supply portions.

A method for manufacturing such a liquid ejection head will be described with reference to FIGS. 2A to 2G. FIGS. 2A to 2G are diagrams showing the manner of production of the liquid ejection head with reference to the cross section of the liquid ejection head along line II-II in FIG. 1.

Figure 2A:
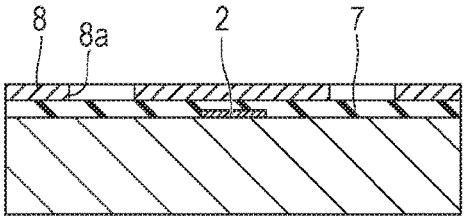
FIGS. 2A to 2G are diagrams showing a method for manufacturing a liquid ejection head.

As shown in FIG. 2A, the substrate 1 provided with the energy generating element 2 on the surface is prepared. In addition to the energy generating element 2, a layer 7 and a layer 8 are disposed on the surface of the substrate 1. The layer 7 and the layer 8 are not shown in FIG. 1. The layer 7 is an insulating layer composed of, for example, SiN, SiC, SiO, or SiCN and is a layer for covering the energy generating element 2. The layer 8 is composed of, for example, an epoxy resin or a polyether amide and is a layer disposed between the substrate 1 and a member formed in a downstream step. The layer 8 is a layer for enhancing the adhesion strength between the substrate 1 and the member.

The layer 8 on the surface of the substrate 1 is patterned so as to have an opening 8*a*. There is no particular limitation regarding a method for patterning the layer 8. For example, a mask formed by photolithography is prepared and patterning is performed by reactive ion etching using the mask. In this manner, the opening 8*a* is formed in the layer 8.

Figure 2B:
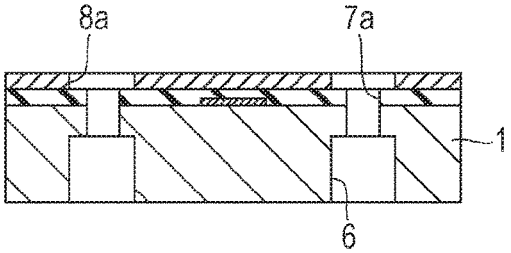

As shown in FIG. 2B, the supply portion 6 that penetrates the surface and the back surface of the substrate 1 is formed in the substrate 1. The supply portion 6 is formed by, for example, subjecting the substrate 1 composed of silicon to reactive ion etching. Alternatively, the supply portion 6 may be formed by laser irradiation, wet etching, a combination thereof, or the like. In FIG. 2B, when the supply portion 6 is formed, an opening 7*a* is formed in the layer 7. Consequently, the substrate 1, the layer 7, and the layer 8 are in the state of being penetrated to form a hole.

The order of the step shown in FIG. 2A and the step shown in FIG. 2B may be reversed. That is, the layer 7 and the layer 8 may be formed after the supply portion 6 is formed, and the opening 7*a* and the opening 8*a* may be formed therein.

Figure 2C:
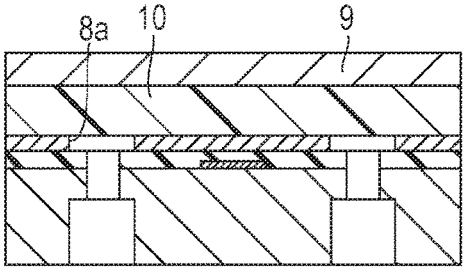

As shown in FIG. 2C, a dry film 10 supported by a support member 9 is attached to the surface of the substrate 1. The support member 9 can be composed of a material that is resistant to heat and is composed of, for example, polyethylene terephthalate or polyimide. The dry film 10 is a member for forming the flow passage and the ejection port on the substrate and serves as the member 5 (or part of the member 5) shown in FIG. 1. From the viewpoint of formation of the flow passage and the ejection port, the dry film 10 can be composed of a photosensitive resin, in particular, a negative photosensitive resin. Examples of negative photosensitive resins include cyclized polyisoprenes containing bisazide compounds, cresol novolak resins containing azidopyrene, and epoxy resins containing diazonium salts and onium salts.

Figure 2D:
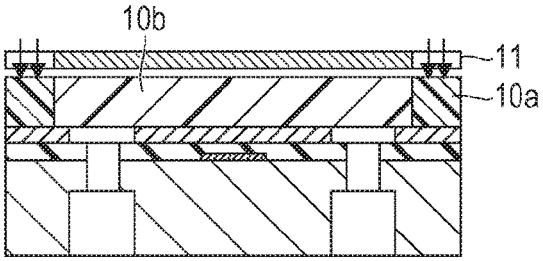

The support member 9 is peeled from the dry film 10. After peeling, as shown in FIG. 2D, the dry film 10 is subjected to exposure by using a mask 11 so as to form a latent image on the dry film 10. In the configuration shown here, the negative photosensitive resin is used as the dry film 10, an exposed portion 10*a* serves as a wall, and an unexposed portion 10*b* is made into the flow passage. After exposure, the dry film 10 is heat-treated. Formation of the latent image on the dry film 10 is completed by the heat treatment.

Figure 2E:
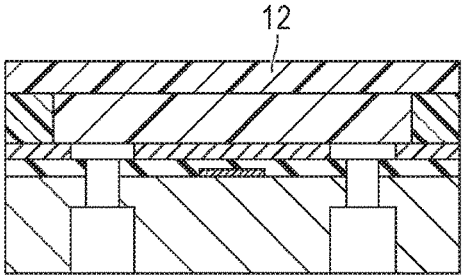

As shown in FIG. 2E, a dry film 12 is formed on the dry film 10 including the latent image. The dry film 12 may be formed by using a support member in the same manner as the dry film 10. However, in the case where the dry film 12 is composed of a photosensitive resin and subjected to exposure, the sensitivity of the dry film 12 and the sensitivity of the dry film 10 have to be different from each other such that the dry film 10 does not respond to light during a step of exposing the dry film 12.

Figure 2F:
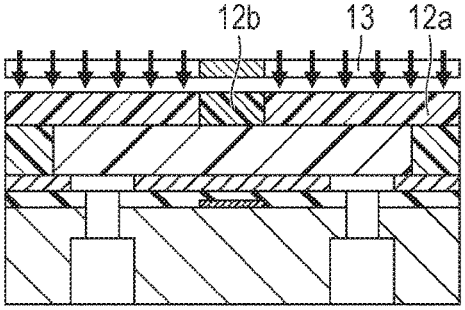

As shown in FIG. 2F, the dry film 12 is subjected to exposure by using a mask 13 so as to form a latent image on the dry film 12. In the configuration shown here, the negative photosensitive resin is used as the dry film 12, an exposed portion 12*a* finally serves as a wall of the ejection port (ejection port forming member), and an unexposed portion 12*b* is made to serve as the ejection port. Thereafter, the dry film 12 is heat-treated. Formation of the latent image on the dry film 12 is completed by the heat treatment.

The dry film 12 may be subjected to a water-repellent treatment or hydrophilization. The material used for these treatments can be a material that does not affect the latent image on the dry film 12.

Figure 2G:
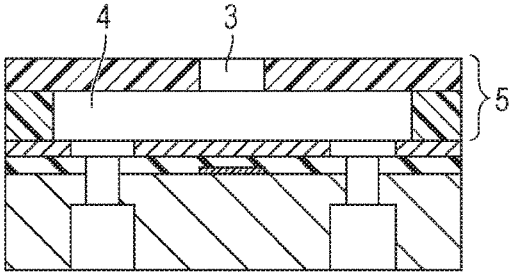

As shown in FIG. 2G, the unexposed portion 10*b* of the dry film 10 and the unexposed portion 12*b* of the dry film 12 are subjected to development by using a developing solution. In this manner, the ejection port 3 and the flow passage 4 are formed so as to produce the member 5. Here, explanations have been made on the assumption that the ejection port 3 and the flow passage 4 are formed by exposure and development, but these may be formed by, for example, reactive ion etching or laser irradiation.

As necessary, the substrate 1 may be cut, and electronic wiring lines for driving the energy generating element 2 may be connected so as to produce the liquid ejection head.

Problems that occur in the above-described method for manufacturing the liquid ejection head will be described. In the step shown in FIG. 2C, the dry film 10 is attached to the surface of the substrate 1, as described above. The surface of the substrate 1 is provided with the layer 8 having the opening 8*a*. The present inventors found that in some cases the dry film 10 fell into the opening 8*a* during attachment of the dry film 10 and, thereby, the shape of the dry film 10 was changed.

Figure 3A:
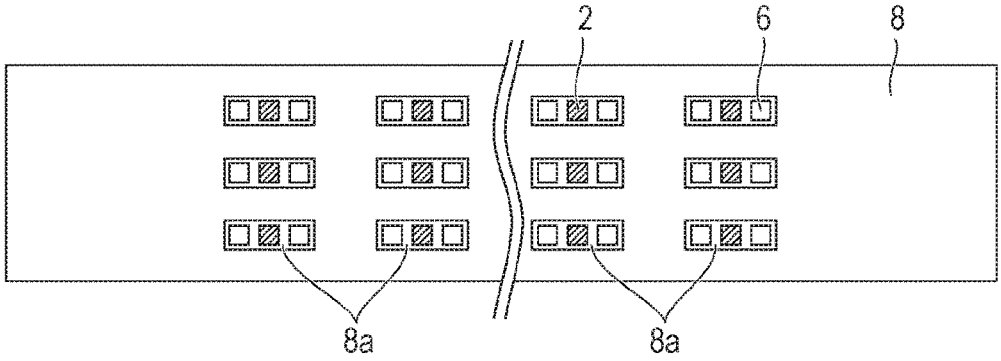
FIGS. 3A to 3C are diagrams showing the configuration of and a manufacturing method for a liquid ejection head.

Falling of the dry film 10 into the opening 8*a* will be described with reference to FIGS. 3A to 3C. FIG. 3A is a diagram of the substrate of the liquid ejection head shown in FIG. 1, when viewed from above, where the member 5 is omitted in the drawing. The layer 8 (not shown in FIG. 1) is present on the surface of the substrate. The openings 8*a* are located in the layer 8. The openings 8*a* are located in accordance with opening portions of the supply portions 6 and the energy generating elements 2. In FIG. 3A, one energy generating element 2 and two supply portions 6 are disposed in one opening 8*a*. The openings 8*a* are arrayed in two array directions of the vertical direction and the lateral direction in FIG. 3A.

Figure 3B:
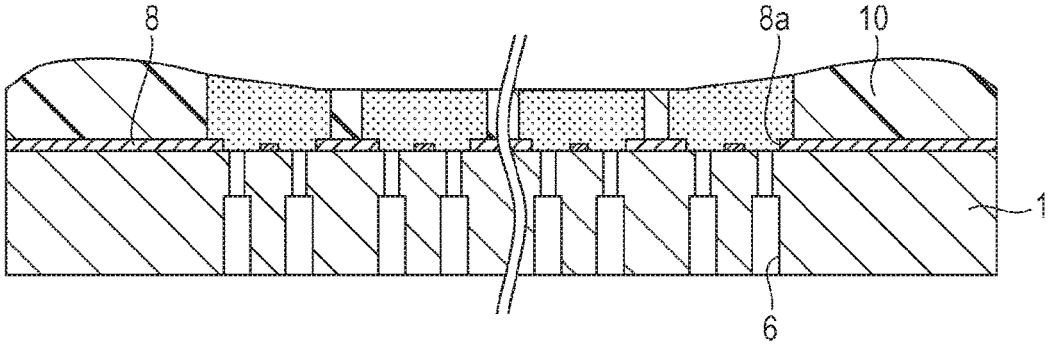

FIG. 3B corresponds to FIGS. 2A to 2G showing the cross section along line II-II in FIG. 1 and illustrates the manner of attachment of the dry film 10 to the substrate shown in FIG. 3A and formation of a latent image by performing pattern exposure and heating thereafter. As shown in FIG. 3B, the dry film 10 falls into the openings 8*a* of the layer 8, and there are variations in the height of the upper surface of the dry film 10. In the center portion of FIG. 3B, the amounts of falling are almost constant, and there is no large unevenness in the height of the upper surface of the dry film 10. However, at the end portions, there are variations in the height of the upper surface. In particular, the height of the upper surface of the dry film 10 is inclined to a great extent above the opening 8*a* at the end of the array.

The area of one opening 8*a* is about 2,500 $\mu m^2$ or more and 10,000 $\mu m^2$ or less whereas the area of one opening portion of the supply portion 6 therein is smaller than about 2,500 $\mu m^2$. The area of one opening portion of the supply portion 6 is about 2,300 μm at maximum, and is generally 300 $\mu m^2$ or more and 2,000 $\mu m^2$ or less. Therefore, the probability of the dry film 10 falling into the supply portion 6 is less than the probability of the dry film 10 falling into the opening 8*a* and may be neglected. Meanwhile, the thickness of the layer 8 is 0.5 μm or more and 3.0 μm or less. Therefore, the depth of the opening 8*a* is also 0.5 μm or more and 3.0 μm or less, and deformation of the dry film 10 easily occurs depending on the depth.

Figure 3C:
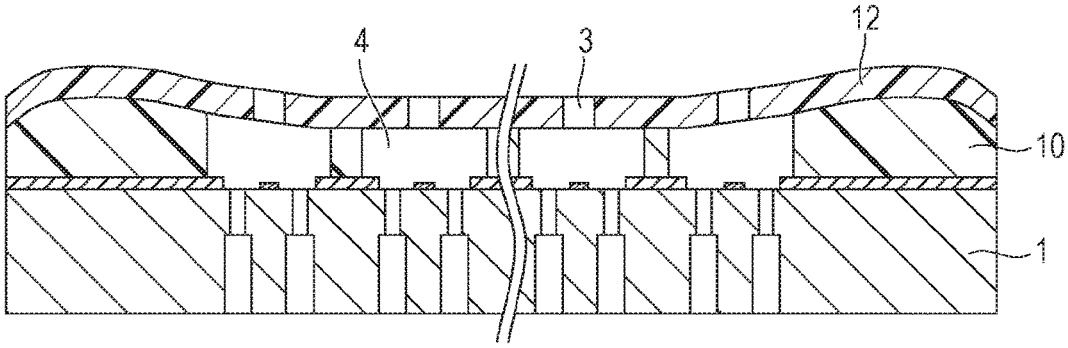

FIG. 3C shows the manner of attachment of the dry film 12 to the dry film 10 in the state shown in FIG. 3B, formation of the ejection ports 3 in the dry film 12, and formation of the flow passage 4 by subjecting the dry film 10 to development. There are variations in the height of the upper surface of the dry film 10. As a result, there are variations in the positions of the ejection ports 3 formed in the dry film 12 depending on the locations, and the heights from the surface of the substrate 1 to the ejection ports 3 differ according to location. Also, the shapes of the flow passages 4 formed by development differ according to location. An occurrence of such a situation influences the ejection volume and the supply rate of the liquid, and in some cases, predetermined images are not formed by the liquid ejected from the ejection ports 3.

In addition, for example, in the case where the ejection ports 3 are formed by photolithography, diffused reflection easily occurs from the substrate side due to deformation of the dry film 10, and the shapes of the ejection ports 3 may be deformed. Further, gaps may be formed between the dry film 10 and the dry film 12 due to deformation of the dry film 10, the gaps may be expanded by application of heat and, as a result, the ejection ports 3 and the flow passages 4 may be deformed.

The present inventors performed intensive research on the above-described problems and, as a result, found that such deformation of the dry film 10 occurred because no opening was located beyond the opening 8*a* at the end in the layer 8.

Figure 4A:
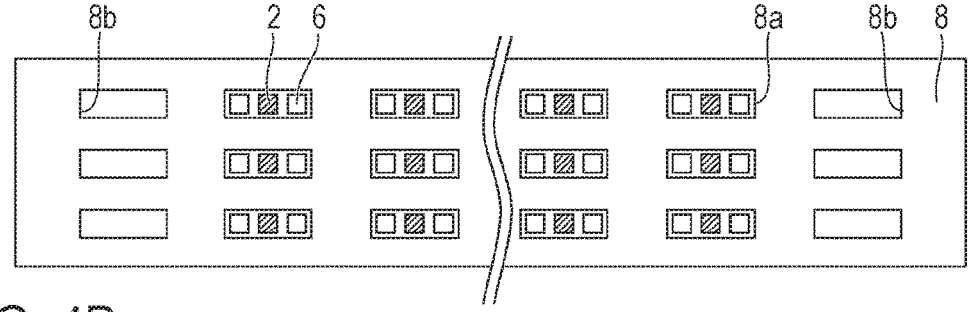
FIGS. 4A to 4E are diagrams showing the configuration of and a manufacturing method for a liquid ejection head.

A method for manufacturing a liquid ejection head according to the present disclosure will be described with reference to FIGS. 4A to 4E. FIG. 4A is a diagram of the substrate of the liquid ejection head shown in FIG. 1, when viewed from above, where the member 5 is omitted in the drawing, in the same manner as FIG. 3A. In the present disclosure, as shown in FIG. 4A, openings 8*b*, in addition to the openings 8*a*, are formed beyond the array of the openings 8*a* in the array direction in the layer 8. In FIGS. 4A to 4E, the openings 8*b* are located beyond both the array of the openings 8*a* (at both ends) in the array direction. The openings 8*a* are a plurality of openings in which the opening portions of the supply portion are located. The openings 8*b* different from the plurality of openings 8*a* are located beyond an outermost opening of the plurality of openings 8*a*.

Figure 4B:
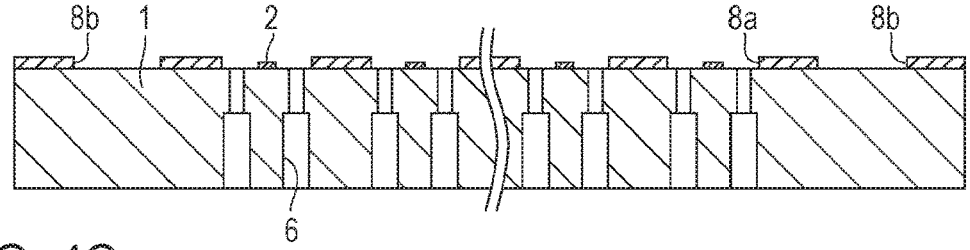

FIG. 4B is a sectional view of the liquid ejection head shown in FIG. 4A. In an example described here, no insulating layer (layer 7) is disposed, but an insulating layer may be disposed. As described with reference to FIG. 4A, the openings 8*b* are located beyond the openings 8*a*. The energy generating element 2 and the opening portions of the supply portions 6 are located in the opening 8*a*, but the energy generating element 2 and the opening portion of the supply portion 6 are not located in the opening 8*b*.

Figure 4C:
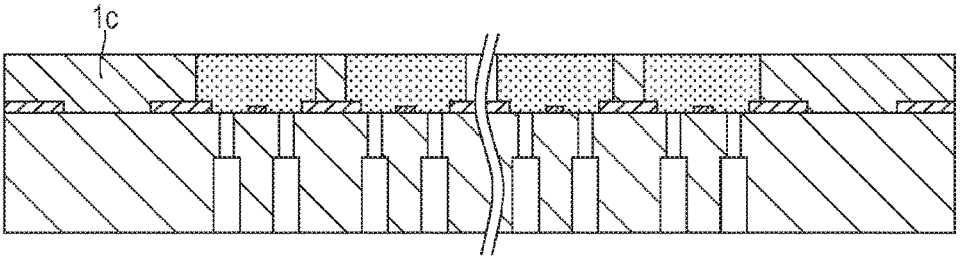

A dry film is attached to the substrate of the liquid ejection head shown in FIGS. 4A and 4B. That is, the dry film is attached to the substrate 1 and the layer 8 having the openings 8*a* and the openings 8*b*. FIG. 4C shows the state in which the dry film 10 is attached to the substrate 1, a support member is peeled from the dry film 10, and the dry film 10 is subjected to exposure and heat treatment.

The dry film 10 falls into the openings 8*a* and also into the openings 8*b* located beyond the openings 8*a*. Therefore, falling of the dry film 10 above the openings 8*a* almost uniform overall. In particular, as shown in FIG. 3B, the difference in the degree of falling increases between the portion above the outermost opening and the portion above the region outside the outermost opening. Therefore, in the case where the opening 8*b* is located beyond the outermost opening 8*a* among the openings 8*a* in the array direction, a change in the height of the dry film 10 due to falling into the outermost opening 8*a* among the openings 8*a* is suppressed.

In FIG. 4C, a latent image is formed on the dry film 10 by the exposure and the heat treatment. In this regard, the heights of the upper surface of the dry film 10 above the openings 8*a* are almost constant because of the openings 8*b*, as described above. Although the height of the dry film 10 may increase in the portion outside the region shown in FIG. 4C, the outside portion does not affect the shapes of the flow passages and ejection ports.

Figure 4D:
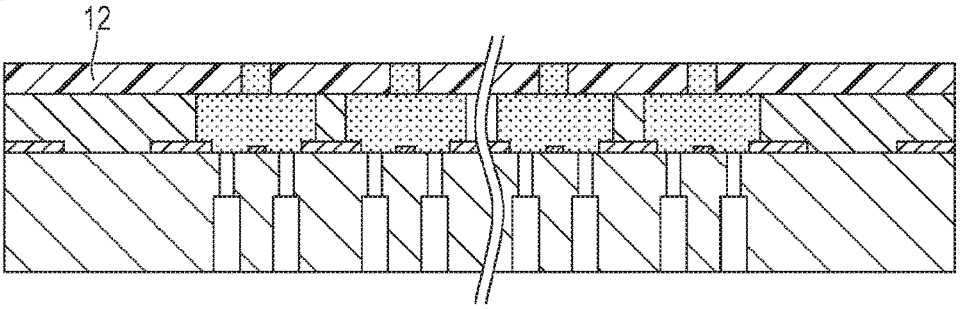

FIG. 4D shows the state in which the dry film 12 is attached to the dry film 10 in the state shown in FIG. 4C and latent images of the ejection ports are formed on the dry film 12. There are no variations in the height of the upper surface of the dry film 10 and, therefore, the shape and the height of the upper surface of the dry film 12 are uniform.

When the dry film 10 is attached, it is desirable that the dry film 10 be softened appropriately, the openings 8*a* and the openings 8*b* be filled therewith, and the height differences of the layer 8 be reduced favorably. Therefore, in consideration of common resin materials and the size of the dry film, the attachment temperature of the dry film is set to be preferably 50° C. or higher and 140° C. or lower, although the attachment temperature depends on the forming material and the size of the dry film. The attachment pressure applied to the dry film 10 is set to be preferably 0.1 MPa or more and 1.5 MPa or less. When the dry film 12 is attached, the temperature of the dry film 12 is set to be preferably 60° C. or higher and 90° C. or lower. Also, the attachment pressure applied to the dry film 12 is set to be preferably 0.1 MPa or more and 0.6 MPa or less.

Figure 4E:
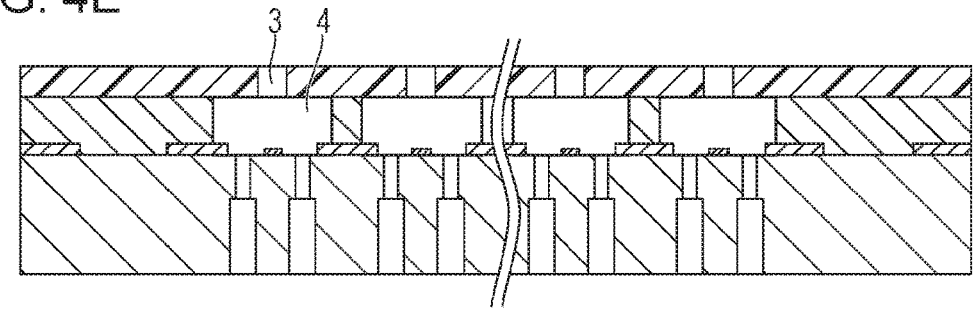

As shown in FIG. 4E, the liquid ejection head shown in FIG. 4D is subjected to development so as to form the ejection ports 3 and the flow passages 4. The height of the upper surface of the dry film 10 is constant and, therefore, the heights of the flow passages 4 do not differ according to location and are constant. Further, differences in the shape of the dry film 12 according to location are suppressed and, thereby, the distances of the ejection ports 3 from the substrate and the shapes of the ejection ports 3 are constant. Therefore, the ejection of the liquid is stabilized and predetermined images are formed on the recording medium.

The pattern for forming the opening 8*b* will be described. The opening 8*b* is formed beyond the openings 8*a* so as to artificially make a situation in which another opening 8*a* is located beyond the array of the openings 8*a*. From this point of view, the opening 8*b* can be analogous to the opening 8*a*. For example, in the cross section of the liquid ejection head shown in FIG. 4A, the width (length in the lateral direction in the drawing) of the opening 8*a* can be the same as the width of the opening 8*b*. Specifically, the width of the opening 8*b* is preferably 80% or more and 120% or less the width of the opening 8*a*. The same goes for the widths of the opening 8*a* and the opening 8*b* in the vertical direction in FIG. 4A.

Also, the areas of the opening 8*a* and the opening 8*b* can be the same. Specifically, the area of one opening 8*b* is preferably 80% or more and 120% or less the area of one opening 8*a*. Further, the pitch of the opening 8*a* (distance between adjacent openings 8*a*) and the pitch of the opening 8*b* (distance between adjacent openings 8*b*) can be the same. Specifically, the pitch of the opening 8*b* is preferably 80% or more and 120% or less the pitch of the opening 8*a*.

In the case where a dummy opening (opening 8*b*) serving as a dummy is formed beyond the array of the openings 8*a*, if the dummy opening is too small relative to the opening 8*a*, it becomes difficult to play the role of the dummy sufficiently. This is because the degree of falling of the dry film into the dummy opening is too small compared with the degree of falling of the dry film into the opening 8*a*. On the other hand, if the dummy opening is too large compared with the opening 8*a*, it also becomes difficult to play the role of the dummy sufficiently because the degree of falling of the dry film into the dummy opening is too large this time. In consideration of these, the opening 8*b* is made to be analogous to the opening 8*a* as long as possible.

Figure 5A:
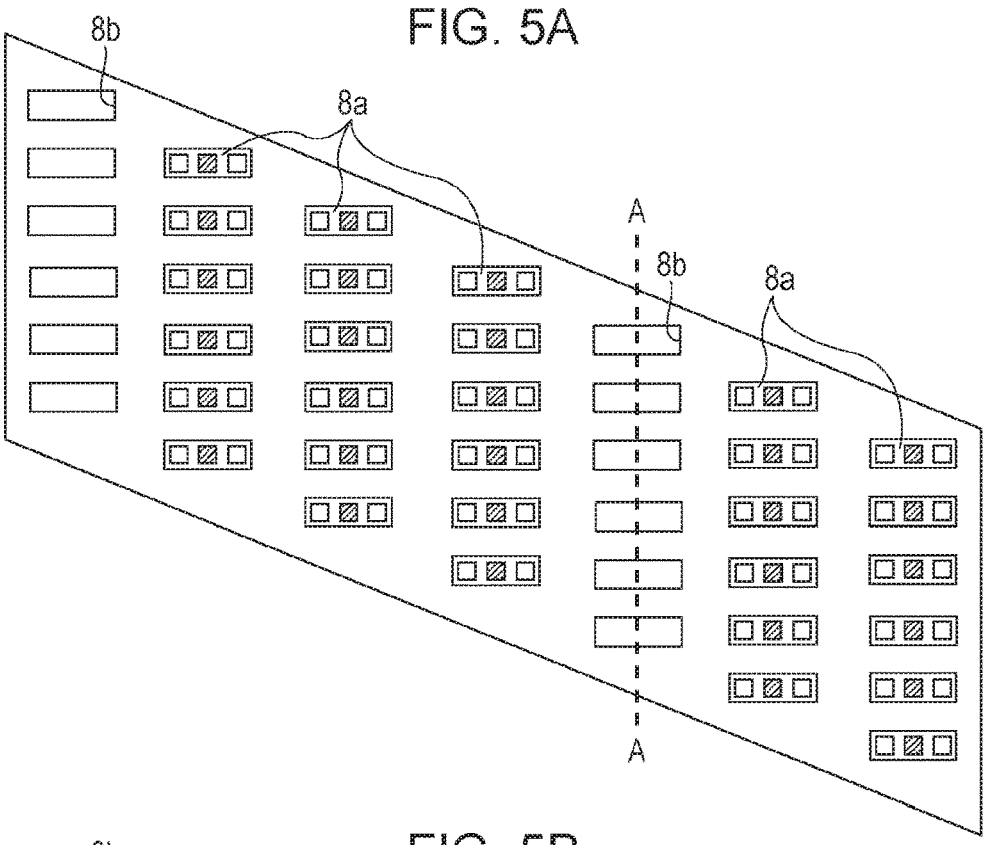
FIGS. 5A and 5B are diagrams showing the configurations of liquid ejection heads.
Figure 5B:
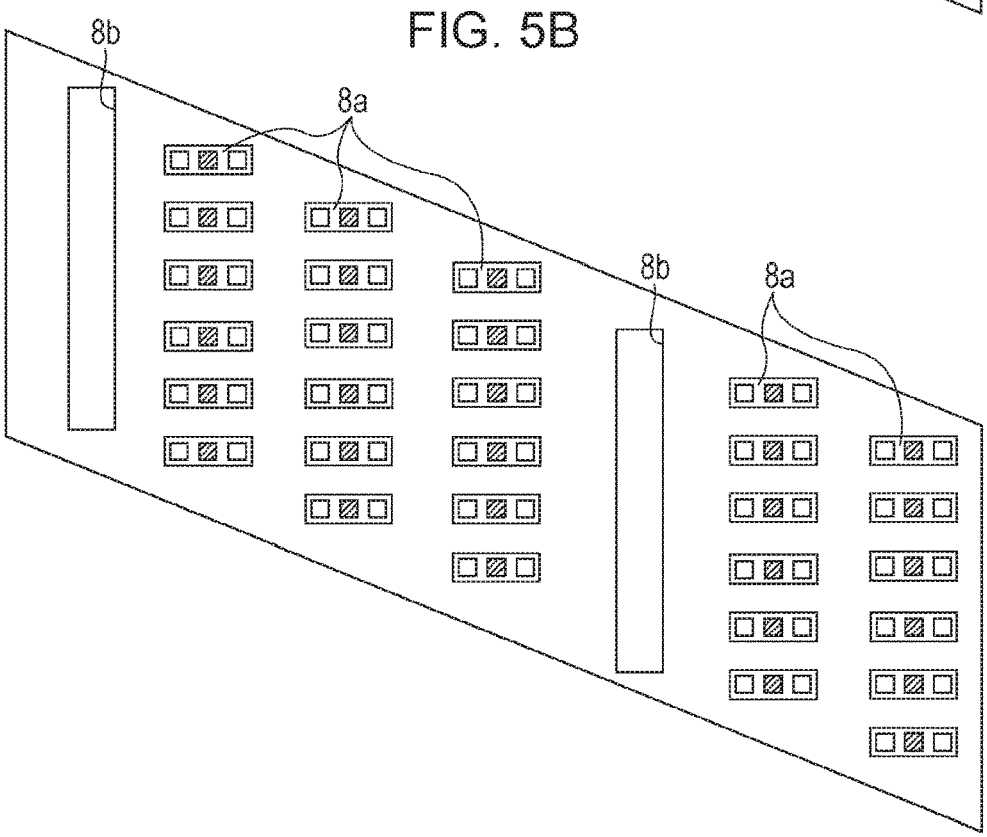

FIGS. 5A and 5B are diagrams of the substrates of the liquid ejection heads when viewed in the same manner as FIG. 3A and FIG. 4A. The shape of the substrate of the liquid ejection head according to the present disclosure may be a parallelogram, as shown in FIGS. 5A and 5B. In the case where the shape of the substrate is a parallelogram, as shown in FIG. 5A, openings 8*b* are located beyond the openings 8*a*. In FIG. 5A, openings 8*b* are also located at positions on a line A-A. The line A-A corresponds to a cutting position of the substrate. That is, FIG. 5A is a diagram showing the state of two liquid ejection heads before cutting. At this time, the opening 8*a* is not located in the portion along the line A-A indicating the cutting position. Then, regarding the openings 8*a* adjoining this portion, changes in the shape of the dry film occur. Therefore, in the present disclosure, openings 8*b* are located at the cutting position of the substrate or around the cutting position. In FIG. 5A, regarding a left liquid ejection head, openings 8*b* are located beyond both outermost openings 8*a* (both ends). The right openings 8*b* among the openings 8*b* are located at the positions along the line A-A.

In the example described with reference to FIG. 5A, the substrates are cut at positions at which the openings 8*b* are located. However, it is not always necessary that the substrates be cut at positions at which the openings 8*b* are located. For example, the substrates may be cut at positions slightly shifted from the openings 8*b*. It is desirable that the openings 8*b* be located between a region including openings 8*a* of one substrate and a region including openings 8*a* of another substrate. In this case, even when the substrates are cut at positions slightly apart from the openings 8*b*, the resulting two substrates include the respective openings 8*a*.

In the above explanations regarding the opening 8*b*, a plurality of openings 8*b* having the same shape as the shape of the opening 8*a* are located. However, the opening 8*b* is not limited to this and, as shown in FIG. 5B, an opening 8*b* may be located so as to extend relative to a plurality of openings 8*a* located separately from each other. That is, the opening 8*b* extends in the direction intersecting the array direction of the openings 8*a*. In this case, for example, the width of the opening 8*b* in the lateral direction in FIG. 5B can be made smaller than the width of the opening 8*a* such that the area of the opening 8*b* do not become too large.

The opening 8*b* is located (open) beyond the openings 8*a*. Regarding "beyond the openings 8*a*", for example, in FIGS. 5A and 5B, the openings 8*b* are located beyond the openings 8*a* in the lateral direction. In FIGS. 5A and 5B, the vertical direction is the longitudinal direction of the substrate and the lateral direction is the transverse direction of the substrate. At this time, the deformation amount of the opening 8*a* on the outer side in the transverse direction of the substrate is smaller than the deformation amount of the opening 8*a* on the outer side in the longitudinal direction of the substrate. Consequently, the openings 8*b* are located only beyond the array of the openings 8*a* in the array direction, that is, in the transverse direction of the substrate. The opening 8*b* is not located beyond the openings 8*a* in the longitudinal direction of the substrate and, thereby, a space is secured. As a matter of course, in the case where the opening 8*b* is also located on the outer side in the longitudinal direction, deformation of the dry film due to falling into the opening 8*a* at the end in the longitudinal direction is suppressed. This point is favorable.

It is considered that the direction of attachment of the dry film is one of the causes of falling of the dry film into the opening. In FIGS. 5A and 5B, the dry film is attached from left to right in the drawing. That is, the attachment direction of the dry film is from left to right. In the case where such an attachment method is employed, deformation of the dry film due to falling occurs easily above the openings 8*a* at the end portions in the lateral direction. From this point as well, in FIGS. 5A and 5B, the openings 8*b* are located beyond the openings 8*a* at the end portions in the lateral direction. That is, the openings 8*b* are located on the near side and the far side, with respect to the attachment direction of the dry film, in the array direction of the openings 8*a*. The opening 8*b* may be located only on the near side in the array direction of the openings 8*a* or may be located only on the far side. Alternatively, the openings 8*b* may be located on the near side and the far side, as in the present example. From the viewpoint of enhancing control of falling of the dry film, the openings 8*b* can be located on both the near side and the far side.

Exemplary Example

The present disclosure will be described below with reference to a specific example.

Example

A substrate of a liquid ejection head, as shown in FIGS. 4A and 4B, was prepared. The substrate 1 was a silicon substrate composed of silicon. The substrate 1 included a plurality of supply portions 6. The supply portions 6 penetrated the substrate from the surface (upper surface) to the back surface (lower surface) and were formed by subjecting the substrate 1 to two-stage reactive ion etching.

Energy generating elements 2 composed of TaSiN were disposed on the surface of the substrate 1. Also, a layer 8 composed of a polyether amide was disposed on the surface of the substrate 1. The thickness of the layer 8 was 2.0 μm. The layer 8 had openings 8*a* and openings 8*b*. The openings 8*a* were located at the positions in accordance with the energy generating elements 2 and the opening portions of the supply portions 6. The energy generating elements 2 and the opening portions of the supply portions 6 were located in the openings 8*a*. The openings 8*b* serving as dummy openings were located beyond the openings 8*a* in the array direction. The opening 8*b* was formed so as to have the same shape, area, and pitch as those of the opening 8*a*. The areas of the opening 8*a* and the opening 8*b* were set to be 3,000 $\mu m^2$. The area of the opening portion of the supply portion 6 located in the opening 8*a* was set to be 300 $\mu m^2$. The openings 8*a* and the openings 8*b* were formed in the layer 8 by reactive ion etching. A mask for the reactive ion etching was composed of SiO and SiN made into a film by using a plasma CVD apparatus. The reactive ion etching was performed by employing a bosch process.

As shown in FIG. 4C, a dry film 10 was attached to the substrate 1. Initially, a member produced by disposing a photosensitive resin composition serving as a dry film on a support member composed of a PET film subjected to a release promoting treatment was prepared. The photosensitive resin composition was a mixture described below.

Epoxy resin (trade name: EHPE3150, produced by DAICEL CHEMICAL INDUSTRIES, LTD.) 100 parts by mass Photocationic polymerization initiator (trade name: SP-172, produced by Asahi Denka Co., Ltd.) 6 parts by mass Binder resin (trade name: jER1007, produced by MITSUBISHI CHEMICAL CORPORATION) 20 parts by mass The dry film 10 was attached by using a transfer apparatus (trade name: VTM-200, produced by Takatori Corporation), and the thickness of the dry film 10 on the surface of the substrate 1 was set to be 14.0 μm. At the time of the transfer, the temperature of the dry film 10 was set to be 70° C. and the pressure applied to the dry film 10 was set to be 0.5 MPa. Subsequently, the support member was peeled at a peeling rate of 5 mm/sec, and the dry film 10 was subjected to pattern exposure and heating. The pattern exposure was performed by using an exposure apparatus (trade name: FPA-3000i5+, produced by CANON KABUSHIKI KAISHA) with i-rays, and the exposure dose was set to be 8,000 J/m$^2$. At the time of exposure, a mask was used so as to form the latent image shown in FIG. 4C on the dry film 10. Heating was performed by using a hot plate at 50° C. for 4 min so as to facilitate a curing reaction of the dry film 10.

The height of the upper surface of the dry film 10 formed on the substrate, as described above, was observed by using an electronic microscope. As a result, it was ascertained that the height on the substrate was substantially constant.

Next, as shown in FIG. 4D, a dry film 12 was attached to the dry film 10, and a latent image of ejection ports were formed on the dry film 12. Initially, a member produced by disposing a photosensitive resin composition serving as a dry film on a support member composed of a PET film subjected to a release promoting treatment was prepared. The photosensitive resin composition was a mixture of 100 parts by mass of epoxy resin (trade name: EHPE3150, produced by DAICEL CHEMICAL INDUSTRIES, LTD.) and 3 parts by mass of photocationic polymerization initiator onium salt. The photocationic polymerization initiator onium salt had photosensitivity higher than the photosensitivity of the photocationic polymerization initiator (SP-172) and generates cations even at a low exposure dose. The dry film 12 was attached by using a transfer apparatus (trade name: VTM-200, produced by Takatori Corporation), and the thickness of the dry film 12 on the dry film 10 was set to be 10.0 μm. At the time of the transfer, the temperature of the dry film 12 was set to be 40° C. and the pressure applied to the dry film 12 was set to be 0.3 MPa. Subsequently, the support member was peeled at a peeling rate of 5 mm/sec, and the dry film 12 was subjected to pattern exposure and heating. The pattern exposure was performed by using an exposure apparatus (trade name: FPA-3000i5+, produced by CANON KABUSHIKI KAISHA) with i-rays, and the exposure dose was set to be 1,000 J/m$^2$. At the time of exposure, a mask was used so as to form the latent image shown in FIG. 4D on the dry film 12. Heating was performed by using a hot plate at 90° C. for 5 min so as to facilitate a curing reaction of the dry film 12. The dry film 10 was also subjected to exposure during exposure of the dry film 12, but a curing reaction of the dry film 10 was not observed because of an effect of the material for forming the dry film 10.

Finally, as shown in FIG. 4E, the dry film 10 and the dry film 12 were subjected to development by using propylene glycol monomethyl ether acetate so as to form ejection ports 3 and flow passages 4.

The resulting liquid ejection head was observed by using an electronic microscope. As a result, the shapes of the flow passages 4 and the heights from the substrate 1 to the ejection ports 3 were constant at any position on the substrate 1.

Further, for example, the liquid ejection head was connected to electronic wiring lines and was mounted on a liquid ejection apparatus. Images were recorded by using the resulting liquid ejection head. As a result, ejection was stable and good images were formed.

Comparative Example

A liquid ejection head was produced in the same manner as the example except that an opening 8*b* was not located.

The resulting liquid ejection head was observed by using an electronic microscope. As a result, the shapes of the flow passages 4 differed according to location. In particular, differences in height were large on the supply portions at the end portions and outside these. Also, the heights of the ejection ports 3 differed according to location in the same manner as the height of the flow passages 4.

The resulting liquid ejection head was mounted on a liquid ejection apparatus and images were recorded. As a result ejection was not stable and predetermined images were not formed in some cases.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2016-083248, filed Apr. 18, 2016, 2017-029506, filed Feb. 20, 2017 which are hereby incorporated by reference herein in their entirety.

What is claimed is:

1. A method for manufacturing a liquid ejection head including a substrate having liquid supply portions that open on a surface of the substrate, a layer disposed on the surface of the substrate, and a member which is disposed on the layer and forms flow passages in communication with ejection ports that are supplied with a liquid from the supply portions and eject the liquid, the method comprising the steps of:

preparing a substrate including, on the surface, a layer having a plurality of openings in which opening portions of the supply portions are located and which are arrayed in an array direction, and another opening which is different from the plurality of openings and is located beyond an outermost opening among the plurality of openings in the array direction;

attaching a dry film to the layer having the plurality of openings and the another opening; and patterning the dry film for forming the flow passage.

2. The method for manufacturing a liquid ejection head according to claim 1, wherein the layer is composed of an epoxy resin.

3. The method for manufacturing a liquid ejection head according to claim 1, wherein the layer is composed of a polyether amide.

4. The method for manufacturing a liquid ejection head according to claim 1, wherein the dry film is composed of a photosensitive resin.

5. The method for manufacturing a liquid ejection head according to claim 1, wherein energy generating elements for generating liquid ejection energy are disposed in the openings in which the opening portions of the supply portions are located.

6. The method for manufacturing a liquid ejection head according to claim 1, wherein the area of one opening, in which the opening portion of the supply portion is located, is 2,500 $\mu m^2$ or more and 10,000 $\mu m^2$ or less.

7. The method for manufacturing a liquid ejection head according to claim 1, wherein the area of one opening portion of the supply portion is 300 $\mu m^2$ or more and 2,000 $\mu m^2$ or less.

8. The method for manufacturing a liquid ejection head according to claim 1, wherein the thickness of the layer is 0.5 μm or more and 3.0 μm or less.

9. The method for manufacturing a liquid ejection head according to claim 1, wherein the width of the other opening is 80% or more and 120% or less of the width of one opening, in which the opening of the supply portion is located.

10. The method for manufacturing a liquid ejection head according to claim 1, wherein the area of the other opening is 80% or more and 120% or less of the area of one opening, in which the opening of the supply portion is located.

11. The method for manufacturing a liquid ejection head according to claim 1, wherein the other opening is located beyond both outermost openings among the plurality of openings in the array direction.

12. The method for manufacturing a liquid ejection head according to claim 1, wherein regarding the direction of attachment of the dry film to the substrate and the layer, the other opening is located on the near side in the array direction.

13. The method for manufacturing a liquid ejection head according to claim 1, wherein regarding the direction of attachment of the dry film to the substrate and the layer, the other opening is located on the far side in the array direction.

14. The method for manufacturing a liquid ejection head according to claim 1, wherein the other opening is located beyond an outermost opening among the plurality of openings in the array direction that is the transverse direction of the substrate.

15. The method for manufacturing a liquid ejection head according to claim 1, wherein a dry film for forming the ejection ports is attached to the dry film.

16. The method for manufacturing a liquid ejection head according to claim 1, wherein a plurality of other openings are located.

17. The method for manufacturing a liquid ejection head according to claim 1, wherein the pitch of the other opening is 80% or more and 120% or less of the pitch of the openings, in which the openings of the supply portions are located.

18. The method for manufacturing a liquid ejection head according to claim 1, wherein the other opening extends in the direction intersecting the array direction of the openings in which the opening portions of the supply portions are located.

19. The method for manufacturing a liquid ejection head according to claim 1, wherein the substrate is cut at the position at which the other opening is located.

20. The method for manufacturing a liquid ejection head according to claim 1, wherein the other opening is located between the substrate including openings, in which the opening portions of the supply portions are located, and a substrate that is different from the substrate including the openings, in which the opening portions of the supply portions are located, and includes openings in which opening portions of supply portions are located.

* * * * *